US011177101B2

(12) United States Patent
Konkol

(10) Patent No.: US 11,177,101 B2
(45) Date of Patent: Nov. 16, 2021

(54) PYROTECHNIC FUSE FOR INTERRUPTING AN ELECTRICAL CIRCUIT

(71) Applicant: Panasonic Industrial Devices Europe GmbH, Luneburg (DE)

(72) Inventor: Rastislav Konkol, Bardowick (DE)

(73) Assignee: Panasonic Industrial Devices Europe GmbH, Luneburg (DE)

( * ) Notice: Subject to any disclaimer, the term of this patent is extended or adjusted under 35 U.S.C. 154(b) by 0 days.

(21) Appl. No.: 16/772,503

(22) PCT Filed: Dec. 13, 2018

(86) PCT No.: PCT/EP2018/084761
§ 371 (c)(1),
(2) Date: Nov. 2, 2020

(87) PCT Pub. No.: WO2019/115691
PCT Pub. Date: Jun. 20, 2019

(65) Prior Publication Data

US 2021/0066010 A1 Mar. 4, 2021

(30) Foreign Application Priority Data

Dec. 15, 2017 (DE) ..... 102017011632.6

(51) Int. Cl.
*H01H 39/00* (2006.01)
*H01H 9/02* (2006.01)

(52) U.S. Cl.
CPC ..... *H01H 39/006* (2013.01); *H01H 9/02* (2013.01)

(58) Field of Classification Search
CPC ..... H01H 9/02; H01H 39/00; H01H 39/006; H01H 2039/008; H01H 85/18; H01H 85/38; H01H 85/40
See application file for complete search history.

(56) References Cited

U.S. PATENT DOCUMENTS 2,861,153 A 11/1958 Adil et al.
4,296,285 A * 10/1981 Lang ..... H01H 39/006 200/61.08

(Continued)

FOREIGN PATENT DOCUMENTS

AT 517872 A1 5/2017
DE 4211079 A1 10/1993

(Continued)

OTHER PUBLICATIONS

International Search Report issued in application No. PCT/EP2018/084761 dated Apr. 18, 2019.

(Continued)

*Primary Examiner* — Jacob R Crum
(74) *Attorney, Agent, or Firm* — Rouget F. Henschel; Potomac Law Group, PLLC

(57) ABSTRACT

The invention relates to a pyrotechnic fuse for interrupting an electrical circuit, comprising a body (9), in which an explosive charge is disposed, wherein: the pyrotechnic fuse comprises a hollow cylinder (11), in which a piston (12) is disposed, beneath which a separation claw (13) is disposed, beneath which the conductor (20), which is to be severed, is disposed; the piston (12) and the separation claw (13) are pressed downwards once the pyrotechnic fuse has been triggered, and the separation claw (13) severs the conductor (20) at two points; a quenching substance storage chamber (14) is disposed outside the cylinder (11), which quenching substance storage chamber, as a result of the piston being pressed downwards once the pyrotechnic fuse has been triggered, is opened towards a separation chamber (15) such that the quenching substance moves into the separation chamber.

10 Claims, 3 Drawing Sheets

(56) References Cited

U.S. PATENT DOCUMENTS

Figure 1:
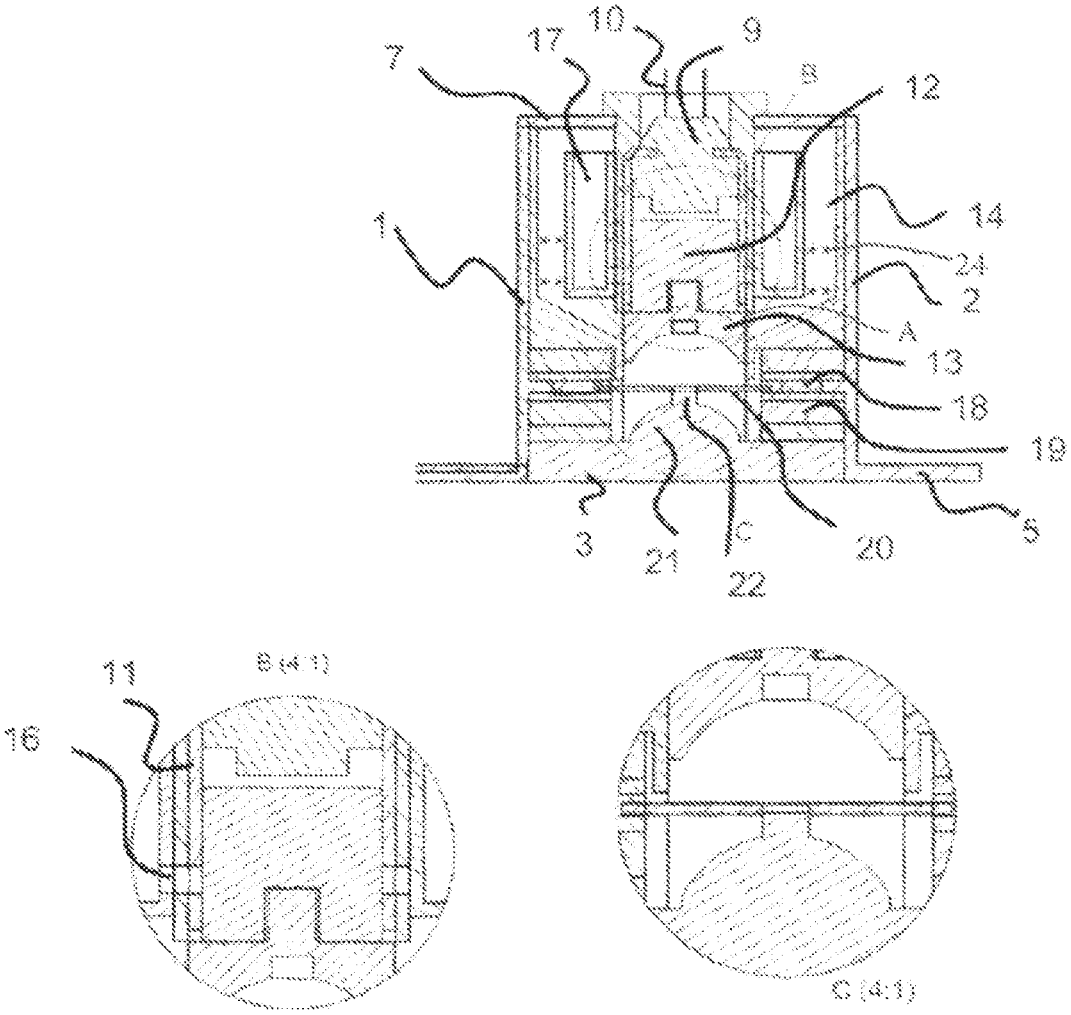

| | | | | |
|---|---|---|---|---|
| 4,342,978 | A * | 8/1982 | Meister | H01H 39/00 200/82 B |
| 6,556,119 | B1 * | 4/2003 | Lell | H01H 39/006 337/157 |
| 2002/0190838 | A1 * | 12/2002 | Kaltenborn | H01H 85/42 337/279 |
| 2010/0218689 | A1 | 9/2010 | Mickelson | |
| 2017/0076890 | A1 | 3/2017 | Hori et al. | |
| 2017/0330714 | A1 | 11/2017 | Muehlen et al. | |
| 2019/0051478 | A1 * | 2/2019 | Warenits | H01H 39/006 |
| 2019/0244778 | A1 * | 8/2019 | Dariavach | H02H 3/021 |
| 2019/0371561 | A1 * | 12/2019 | Ehrhardt | H01H 85/08 |

FOREIGN PATENT DOCUMENTS

| | | | |
|---|---|---|---|
| DE | 19749896 | A1 | 6/1999 |
| DE | 102011014343 | A1 | 9/2012 |
| DE | 102016116781 | A1 | 3/2017 |
| FR | 3051282 | A1 | 11/2017 |
| JP | 2014049272 | A | 3/2014 |
| WO | 2017066816 | A1 | 4/2017 |
| WO | 2018095602 | A1 | 5/2018 |

OTHER PUBLICATIONS

International Search Report issued in application No. PCT/EP2018/084765 dated Apr. 17, 2019.

* cited by examiner

Detail B

Detail C

PYROTECHNIC FUSE FOR INTERRUPTING AN ELECTRICAL CIRCUIT

The invention relates to a pyrotechnic fuse (PTS) for interrupting an electrical circuit.

One possible field of use for such a pyrotechnic fuse (PTS) is electric vehicles and other battery applications. Particularly in the case where an electric vehicle is involved in an accident, it may be necessary to disconnect an electrical circuit rapidly and safely.

Pyrotechnic fuses are known, in particular those which are driven actively for triggering. However, it has been found that the known pyrotechnic fuses cannot disconnect with sufficient safety in the entire range of the voltages and/or currents that possibly occur in electromobility.

Therefore, it is an object of the invention to provide a pyrotechnic fuse (PTS) which achieves a disconnection with higher safety at high voltages and/or currents. The object is achieved by means of a pyrotechnic fuse as claimed in patent claim 1. Further advantageous embodiments are the subject matter of the dependent claims or are described below.

Preferably, the pyrotechnic fuse is activatable by an electrical igniter. Preferably, the disconnecting claw is embodied in a solid fashion, such that it withstands a plasma fire for the required time. Preferably, the disconnecting claw consists of insulating material. Preferably, the disconnecting claw is immersed in a chamber with extinguishing substance such as extinguishing sand, for example, after the disconnection and/or it is covered with an extinguishing substance from above after the disconnection.

Preferably, the residual pressure of the explosion of the explosive substance is used to accelerate the movement of the extinguishing substance into the disconnecting chamber.

Preferably, a counterpart to the disconnecting claw is situated below the conductor to be disconnected, the shape of said counterpart being complementary to that of the disconnecting claw. Preferably, the counterpart has the shape of a dome. Particularly advantageously, a cylinder is seated on the apex of the dome, the horizontal end face of said cylinder being arranged below the conductor.

Preferably, the PTS has a permanent magnet and also a magnetic field concentrator arranged parallel to the conductor to be disconnected. As a result, plasma sparks that possibly arise after the disconnection can be extinguished.

In one preferred embodiment, two opposite side walls of the PTS are formed by plates consisting substantially of iron.

In one advantageous embodiment, two opposite side walls of the PTS are formed by plates which are premagnetized, such that plasma sparks that possibly arise in the PTS after the disconnection can be extinguished with the aid of the magnetic field generated by them.

It is advantageous if the PTS can withstand high pressures. A pressure relief valve can be realized by weakening of the sheath.

The invention is explained in greater detail with reference to the figures. In the figures:

FIG. 1: shows a PTS according to the invention.

Figure 2:
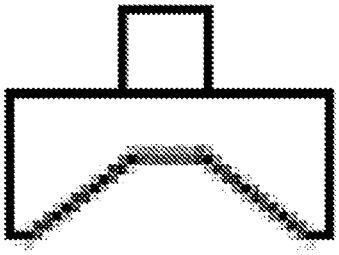

FIG. 2: shows one preferred embodiment of a disconnecting claw

Figure 3:
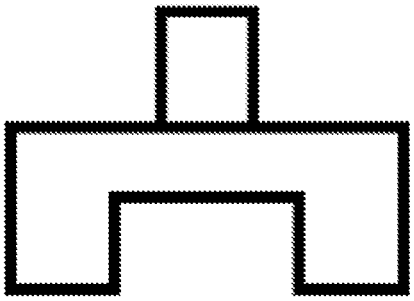

FIG. 3: shows one preferred embodiment of a disconnecting claw

Figure 4:
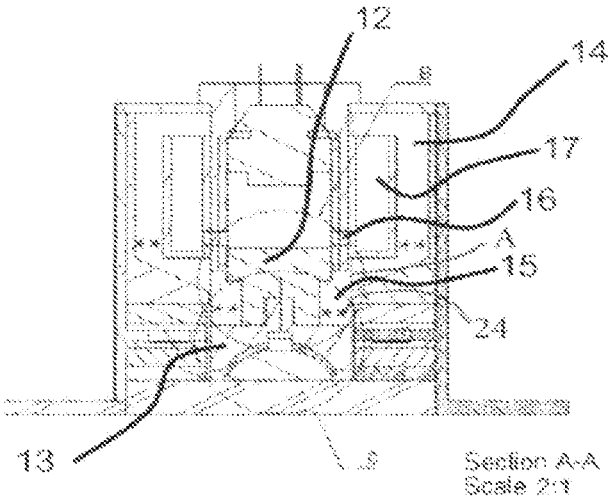
Figure 4:
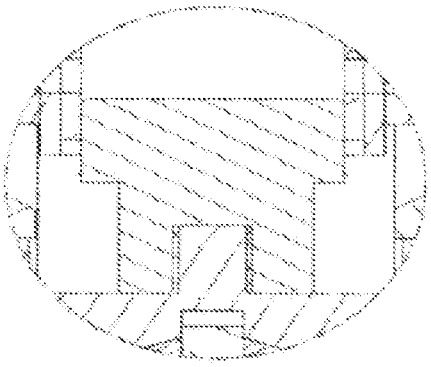
Figure 4:
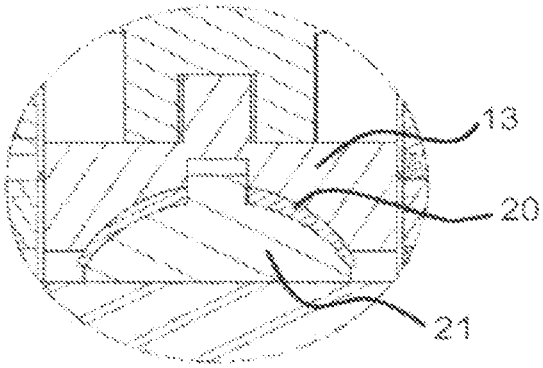

FIG. 4: shows a PTS according to the invention after triggering

FIG. 1 shows a PTS according to the invention in a vertical cross section before triggering. In the plane of the base face 3, a rectangular metal plate 5 respectively extends outward from each end face 1,2.

Both end walls 1,2 are respectively connectable to an end of a conductor, for example composed of copper, that is part of the electrical circuit.

The side walls of the PTS which are not end walls 1,2 comprise an insulation sheath 7 having suitable thermal properties.

The PTS comprises a body 9 with an explosive charge situated therein. The PTS is activatable by an electrical igniter the contacts 10 of which are situated at the top side of the interrupting device.

The PTS comprises a hollow cylinder 11, in which a piston 12 is situated. A disconnecting claw 13 is situated below the piston. When the explosive charge explodes, the piston 12 and thus also the disconnecting claw 13 are pressed downward.

As shown in FIG. 1, a supply of extinguishing sand 24 is situated in a chamber 14 outside the cylinder 11. As long as the PTS has not triggered, as is the the case in FIG. 1, disconnecting claw 13, with its outer surfaces, closes an opening at "A" in the extinguishing sand supply chamber 14. FIG. 4 shows the interrupting device after the triggering of the PTS. When the piston 12 and the disconnecting claw 13 are pressed downward and reach their end position after the triggering of the PTS, the extinguishing sand supply chamber 14 is opened at "A" so that the sand, which was previously held against the outer surfaces of the disconnecting claw 13 (see FIG. 1), may then move through the opening at "A" and toward and into the disconnecting chamber 15 as a result. As a result of the piston 12 and the disconnecting claw 13 being pressed down, holes 16 are furthermore opened, through which pressure can escape into the extinguishing sand supply chamber 14 through a pressure diverting channel 17, as a result of which the extinguishing sand, which is sealed from above, is forced from the extinguishing sand supply chamber 14 into the disconnecting chamber 15. The residual pressure of the explosion is thus used to bring about or to accelerate the movement of the extinguishing substance, which is intended to smother a plasma fire that possibly arises, into the disconnecting chamber 15.

The PTS has a permanent magnet 18 and also a magnetic field concentrator 19 composed of cold-rolled iron sheets or soft iron wires, which is arranged parallel to the conductor 20 that is intended to be severed. Plasma sparks that possibly arise in the PTS after the disconnection are thereby intended to be able to be extinguished.

The counterpart 21 to the disconnecting claw 13 is situated below the conductor 20 to be severed by the disconnecting claw 13, the shape of said counterpart being complementary to that of the disconnecting claw. The counterpart 21 is likewise composed of insulating material. The counterpart has the shape of a dome with a cylinder 22 seated on its apex, the horizontal end face of said cylinder being arranged below the conductor 20.

When the disconnecting claw 13 is pressed downward upon the triggering of the PTS, it severs the conductor 20 at two points. That piece of the conductor 20 which is cut out in this way is fixed by virtue of the fact that it is clamped in between the cylinder 22 at the apex of the counterpart and the disconnecting claw, and is deformed by the shape of the counterpart 21 and/or of the disconnecting claw 13, such that the insulation clearance becomes maximal.

FIGS. 2 and 3 show preferred embodiments of the disconnecting claw 13.

The invention claimed is:

1. A pyrotechnic fuse (PTS) for interrupting an electrical circuit, comprising:

a body with an explosive charge situated therein, wherein the PTS comprises a hollow cylinder in which a piston is situated, below which a disconnecting claw is situated, below which is situated a conductor intended to be severed for interrupting the electrical circuit, wherein the piston and the disconnecting claw are configured to be pressed downward after the PTS is triggered, whereby the disconnecting claw severs the conductor at two points, wherein an extinguishing substance supply chamber is situated outside the cylinder and is configured to open toward a disconnecting chamber when the piston is pressed downward after the PTS is triggered, such that an extinguishing substance moves from the extinguishing substance supply chamber into the disconnecting chamber.

2. The PTS as claimed in claim 1, wherein the PTS is activatable by an electrical igniter.

3. The PTS as claimed in claim 1, wherein the disconnecting claw is embodied in a solid fashion to withstand a plasma fire for a required time.

4. The PTS as claimed in claim 1, wherein residual pressure of an explosion of the explosive charge accelerates movement of the extinguishing substance into disconnecting chamber.

5. The PTS as claimed in claim 1, wherein a counterpart to the disconnecting claw is situated below the conductor, said counterpart having a shape complementary to that of the disconnecting claw.

6. The PTS as claimed in claim 5, wherein the counterpart has a dome shape.

7. The PTS as claimed in claim 6, wherein a cylinder is seated on the apex of the dome, said cylinder having a horizontal end face arranged below the conductor.

8. The PTS as claimed in claim 1, wherein the PTS has a permanent magnet and a magnetic field concentrator arranged parallel to the conductor.

9. The PTS as claimed in claim 1, wherein two opposite side walls of the PTS are formed by iron plates.

10. The PTS as claimed in claim 9, wherein the iron plates are premagnetized, whereby a magnetic field from the premagnetized iron plates can extinguish plasma sparks arising in the PTS after interruption of the electrical circuit.

* * * * *